United States Patent [19]

Nakai

[11] Patent Number: 4,763,497

[45] Date of Patent: Aug. 16, 1988

[54] LOCK DEVICE FOR DOUBLE SLIDING DOORS

[75] Inventor: Hatsuo Nakai, Toyonaka, Japan

[73] Assignee: Clover Co., Ltd., Osaka, Japan

[21] Appl. No.: 938,684

[22] Filed: Dec. 5, 1986

[30] Foreign Application Priority Data

Sep. 3, 1986 [JP] Japan ..... 61-135827[U]
Sep. 13, 1986 [JP] Japan ..... 61-140847[U]

[51] Int. Cl.[4] ..... E05B 65/08

[52] U.S. Cl. ..... 70/95; 70/100; 70/213; 292/207

[58] Field of Search ..... 292/207, 203, 204; 70/90, 213, 214, 89, 95, 100, 219, 312

[56] References Cited

U.S. PATENT DOCUMENTS

| | | | |
|---|---|---|---|
| 445,108 | 1/1891 | Wright | 292/207 |
| 1,061,283 | 5/1913 | Griffin | 292/204 |
| 1,097,379 | 5/1914 | Tresselt | 70/90 |
| 1,507,351 | 9/1924 | Heym | 70/312 |
| 1,966,334 | 7/1934 | Cruse | 70/213 |
| 2,613,526 | 10/1952 | Holmsten | 70/90 |
| 3,600,019 | 8/1971 | Toyota | 292/207 X |
| 4,036,039 | 7/1977 | Nakanishi | 70/90 |
| 4,267,716 | 5/1981 | Milles | 70/312 X |

FOREIGN PATENT DOCUMENTS

| | | | |
|---|---|---|---|
| 174053 | 7/1906 | Fed. Rep. of Germany | 292/207 |
| 393852 | 11/1908 | France | 292/207 |
| 2519 | of 1871 | United Kingdom | 292/207 |
| 8250 | of 1884 | United Kingdom | 292/207 |
| 452295 | 8/1936 | United Kingdom | 70/89 |

*Primary Examiner*—Lloyd A. Gall
*Attorney, Agent, or Firm*—Jordan and Hamburg

[57] ABSTRACT

A hook device for double sliding doors includes a stationary hook fixed to one door of the sliding doors and a rotary hook operable to engage and disengage the stationary hook fixed to the other sliding door. A code lock for setting a lock-hold mode and a lock-release mode provides security even in case when the glass of the doors may be broken and a hand is inserted to reach the lock device in an attempt to unlock it.

8 Claims, 9 Drawing Sheets

LOCK DEVICE FOR DOUBLE SLIDING DOORS

BACKGROUND OF THE INVENTION

The present invention relates to a lock device called a "Crescent Lock" and which is applied to double sliding doors.

Conventionally, this type of lock device is composed of a stationary hook fixed to one sliding door and a rotary hook fixed to another sliding door so that the rotary hook may be arranged to engage the stationary hook. When the doors are closed, the doors can be locked with the rotary hook being rotated to engage the stationary hook and the doors can be unlocked with the rotary hook being rotated in a reverse direction for disengagement from the stationary hook.

The lock device described above is usually provided with a lock-hold mechanism by which the rotation of the rotary hook is restricted. In the lock-hold mechanism a rotary shaft for the rotary hook has a projection piece which rotates with the rotary hook in one body and on the other hand a sliding type stopper having an operation unit is arranged on a setting base. The stopper is designed to rise above or retract under the surface of the rotational path when the operation unit is operated in reciprocation to allow the rotary hook to be set on or released from the stationary hook respectively.

If such a lock device is applied to double sliding doors and someone breaks a part of the glass of the door near the lock device, he can insert his hand into the room and release the lock from its lock-hold mode using the operation unit and turn the rotary hook to be unlocked opening the way for entering into the room illegally without difficulty.

The inventor first considered to provide a key-operated lock mechanism additionally to this lock device. If the locks of this type are arranged on all windows of a building, all lock-hold mechanisms may be released with a single key if such a system is designed to use a common key. In such a case, a problem will arise when the key is stolen or lost. On the contrary, if a separate kind of key is used for each lock-hold mechanism, the number of the keys becomes so numerous that their control is naturally a troublesome problem.

SUMMARY OF THE INVENTION

The lock device for double sliding doors in the present invention is composed of a stationary hook fixed to one sliding door and a rotary hook arranged on another door so that it can engage the stationary hook. The lock device is further equipped with a stopper which is designed to rise above or retract under the surface of the path on which said rotary hook rotates, a code lock which controls the rise or descent of the stopper to set the rotary hook at a lock-hold mode or lock-release mode respectively, and an operation unit which forces the stopper to retreat from the rotation path of the rotary hook when the code lock is held at the lock-hold mode.

Accordingly, it is the object of this invention to provide a new lock device applicable to double sliding doors which is provided with such performance without any fear of release of the lock-hold mode even when someone's hand might be inserted into the room from a broken part of glass and operated to unlock the lock device.

The above-mentioned object, features and effects of the invention may become understood more clearly from the following detailed description of the invention, with reference made to the accompanying drawings.

DETAILED DESCRIPTION OF THE PREFERRED EMBODIMENT

Figure 1:
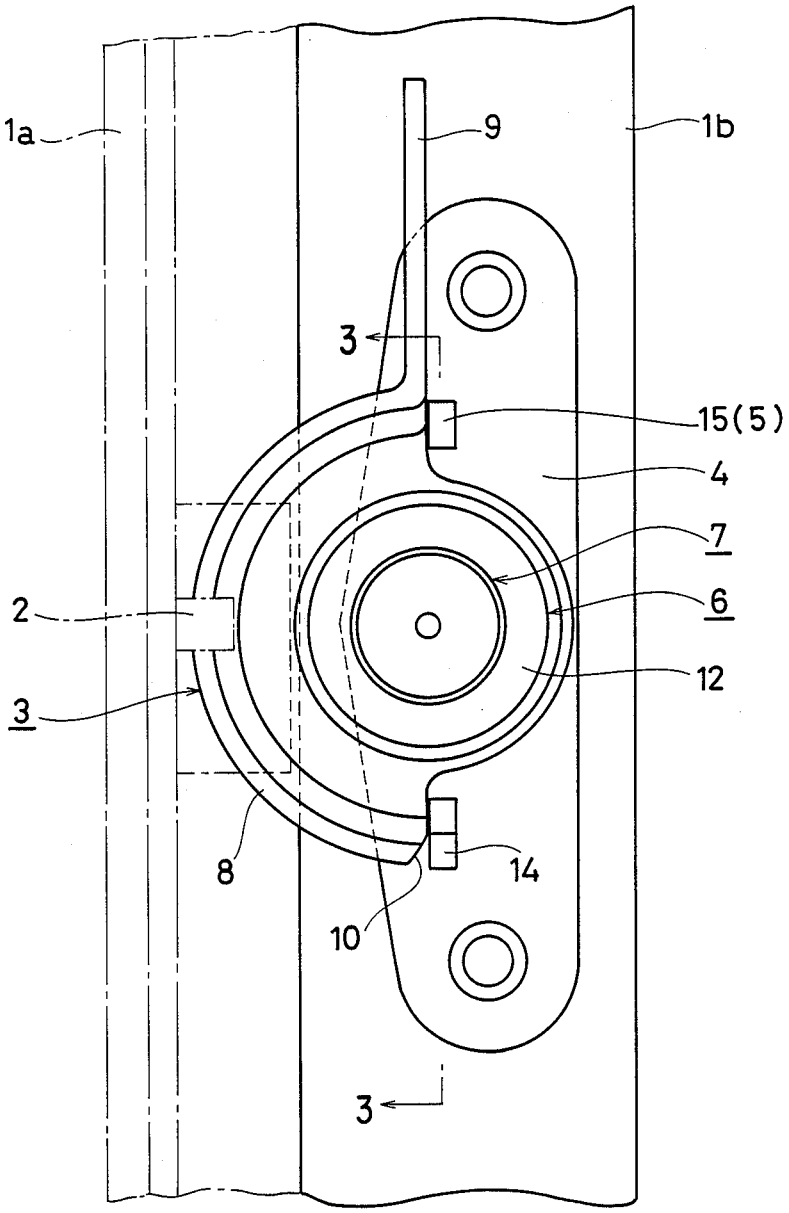
FIG. 1 is a front view of the lock device according to one embodiment of this invention as it is fixed to one of the sliding doors 1*a* and another door 1*b*.
Figure 2:
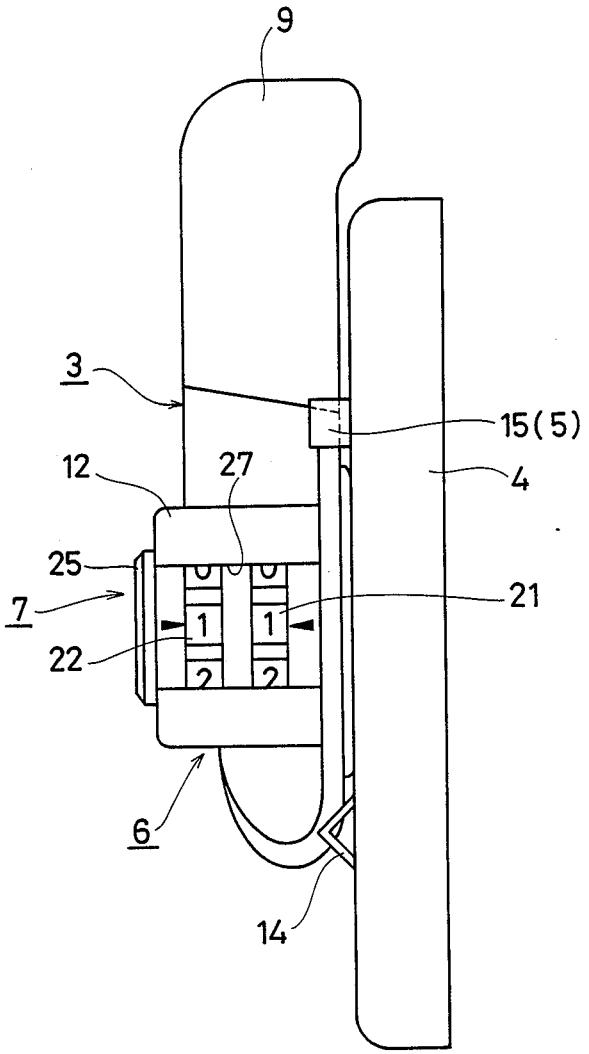
FIG. 2 is a side view of the lock device in FIG. 1.

FIGS. 1 and 2 show the fixed state of the lock device mounted on double sliding doors according to one embodiment of this invention.

The lock device is composed of a stationary hook 2 which is fixed to one sliding door 1*a* and a rotary hook 3 which is fixed to another sliding door 1*b*. The rotary hook 3 is arranged to engage the stationary hook 2. The rotary hook 3 is placed on the surface of a setting base 4 so that the hook can rotate on the surface. On the setting base 4 of the rotary hook 3, a stopper 5 is mounted which rises above and which retracts under the surface of the rotational path of the rotary hook 3, and a code lock 6 is also equipped to control the movement of the stopper 5 to rise or retract for keeping the rotary hook 3 either at a lock-hold mode or lock-release mode respectively. The code lock has furthermore an operation unit 7 which forces the stopper 5 to retract out of the rotation path of the rotary hook 3 in the lock-release mode.

The rotary hook 3 is made by a press-formed metal sheet having a semi-circularly bent upright wall 8 and a handle 9 at one end formed in continuation. The above mentioned upright wall 8 is designed to engage or disengage from the groove of the stationary hook 2 and the upright wall surface is formed lower in height at its end portion and gradually higher toward the handle 9.

Figure 3:
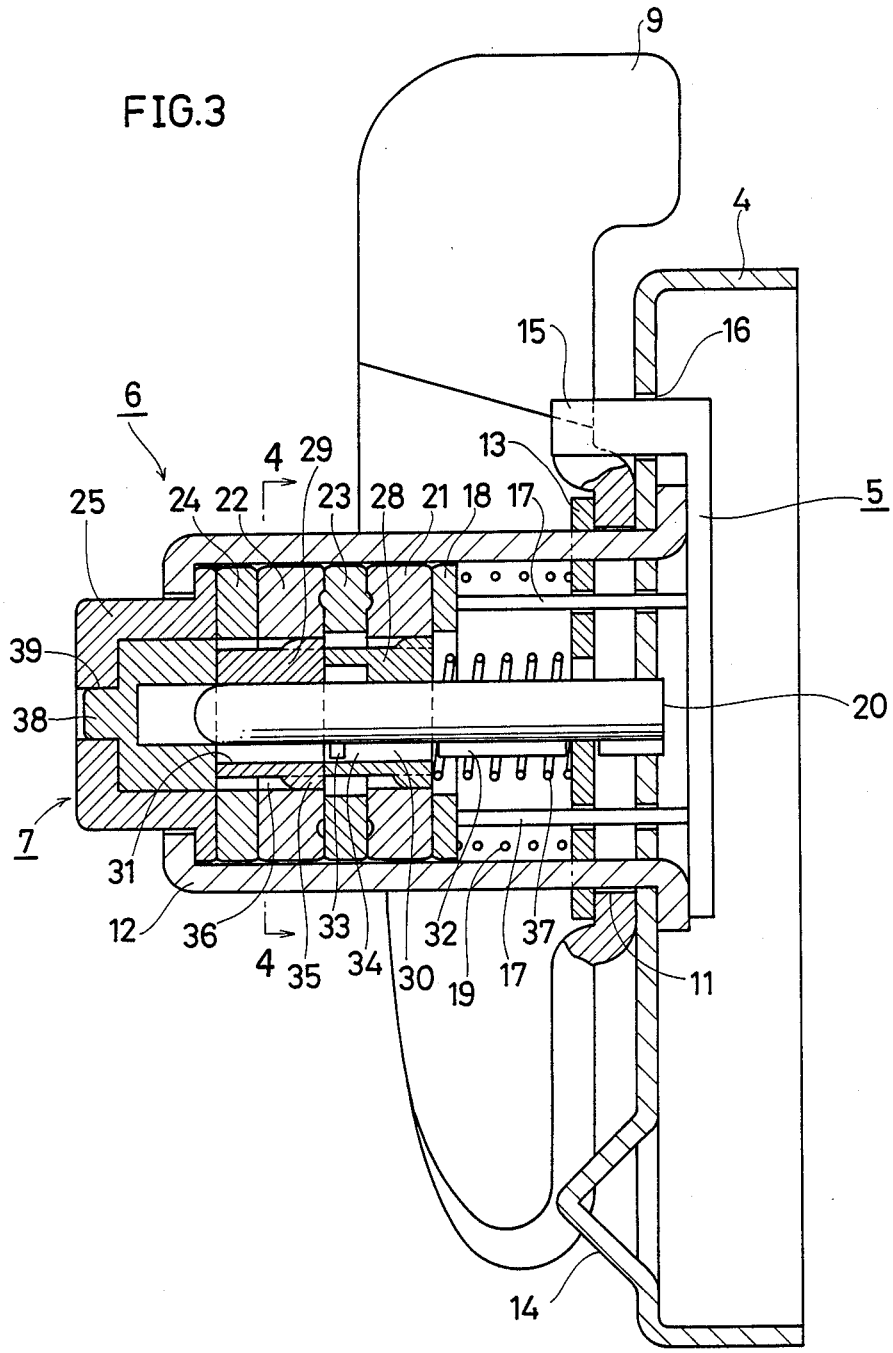
FIG. 3 is a sectional view taken on the line 3—3 in FIG. 1.
Figure 4:
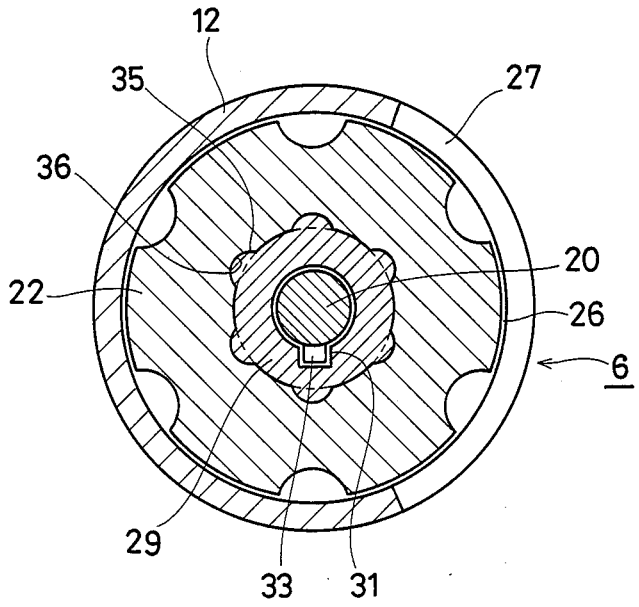
FIG. 4 is a sectional view taken on the line 4—4 in FIG. 3.
Figure 5:
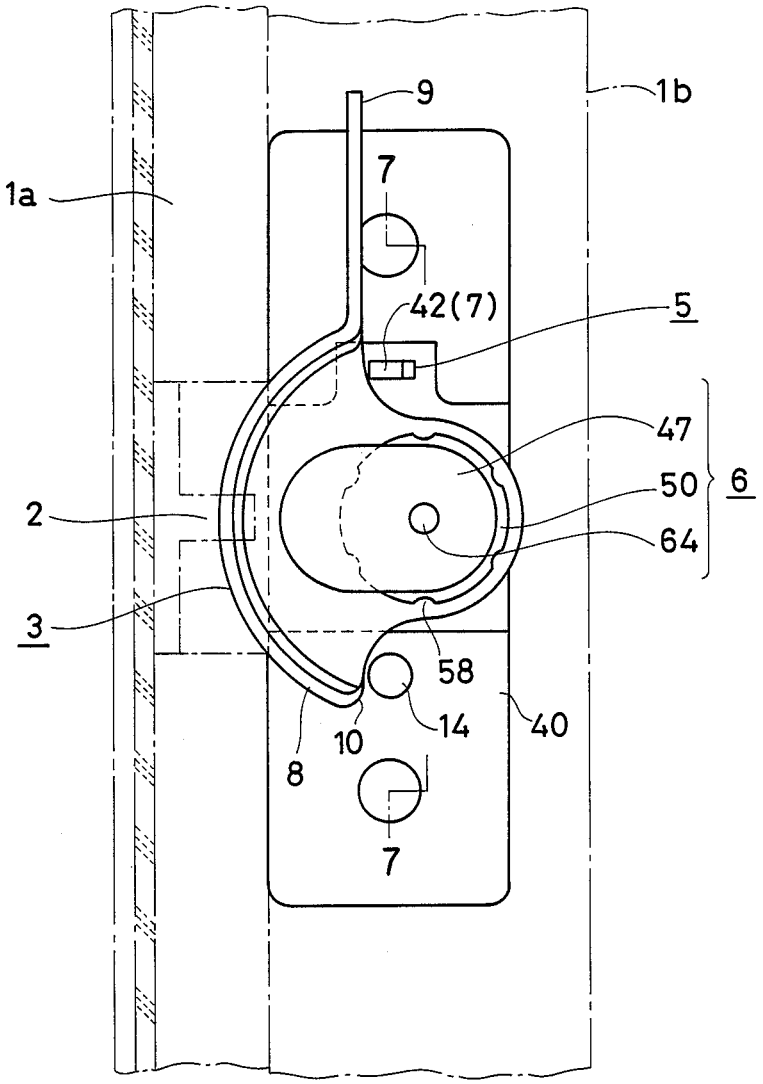
FIG. 5 is a front view of the lock device according to a second embodiment of this invention as it illustrates a fixed state.
Figure 6:
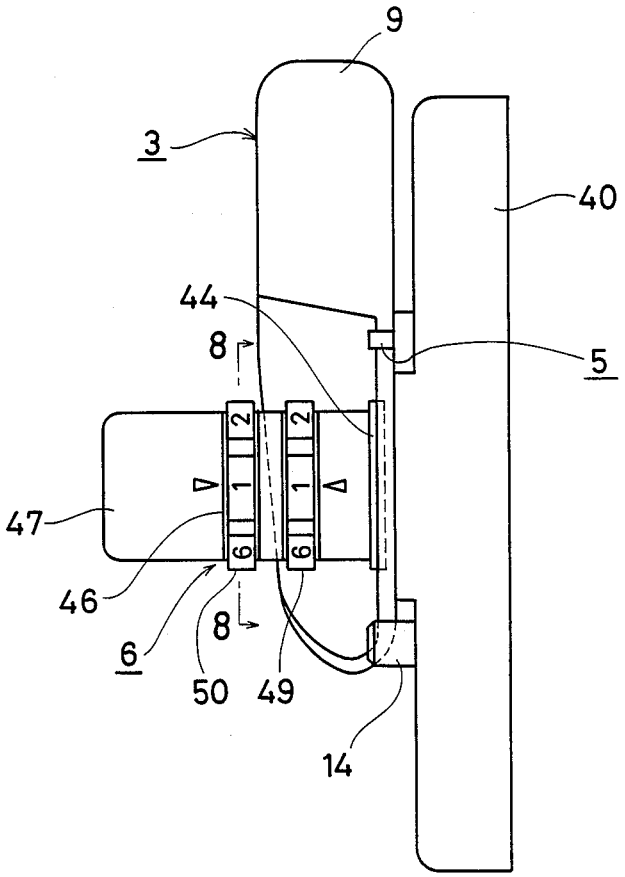
FIG. 6 is a side view of the lock device in FIG. 5.
Figure 7:
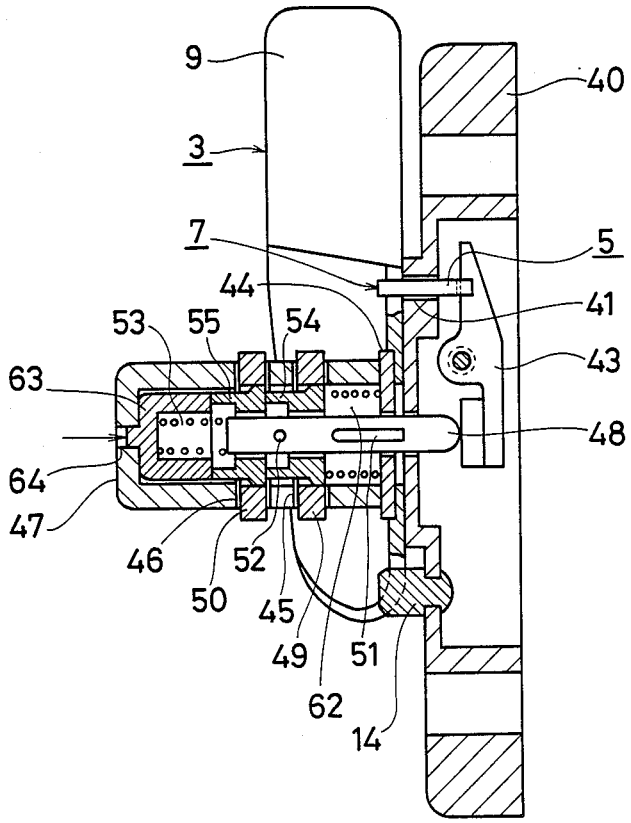
FIG. 7 is a sectional view taken on the line 7—7 in FIG. 5.
Figure 8:
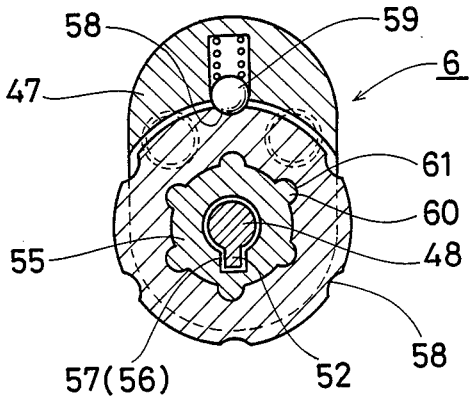
FIG. 8 is a sectional view taken on the line 8—8 in FIG. 6.

The rotary hook 3 is supported on the setting base 4 in a manner so that it can freely rotate in both directions. As FIG. 3 shows, the rotary hook 3 has a bore 11 at its center, and a cylindrical case 12 is also installed on the setting base 4 for incorporating the code lock 6 and operating unit 7 in a manner such that the cylindrical case 12 is vertically set on the setting base 4, pivotally fitting the rotary hook 3 and pushing downward by a push board 13. The numeral 14 in FIGS. 1 through 3 indicates a stopping piece for restricting the rotation angle of the rotary hook.

The stopper 5 is intended for keeping the rotary hook 3 at the lock-hold mode and its main body is situated inside the setting base 4 right under the cylindrical case 12. The end of the stopper 5 is bent to form a projection piece 15 which is designed to rise above the surface of the circular path of the rotary hook 3 through a hole 16 bored on the setting base 4. The stopper 5 is supported by the supporting rods 17, 17 and these supporting rods 17, 17 are connected with a slide plate 18 which is arranged to slide reciprocally in the cylindrical case 12. A compression spring 19 is arranged between the slide plate 18 and the above-mentioned push board 13 under the cylindrical case 12 and such compression spring 19 urges the slide plate 18 upwardly.

The code lock 6 controls the movement of the stopper 5 to rise or retract as described above for setting the rotary hook 3 at a lock-hold mode or lock-release mode, for which a supporting shaft 20 is mounted in a fixed manner at the center of the cylindrical case 12 to accommodate on it the slide plate 18, a plurality of dials 21, 22, a plurality of retainers 23, 24 and a push button 25 all of which are arranged in alignment to freely reciprocate in the case.

As shown in FIG. 2, each dial 21, 22 are given code numbers 1, 2, 3, and etc. with an equal distance kept on their outer peripheral surface 26, making it possible to read the code numbers through the window opening 27 opening on the cylindrical case 12 within a range of a certain scope of angles by matching the code numbers with the window opening 27. Into the internal holes of each dial 21, 22, bushes 28, 29 are fit-in, with their inner surface being provided with concave grooves 30, 31 at a certain specified angle respectively. These grooves 30, 31 engage and disengage from the longitudinal projections 32, 33 formed on the surface of the supporting shaft 20 respectively. On the other hand, one longitudinal projection 32 is installed at a place at variance with the bush 28, and another longitudinal projection 33 is installed in a circular path 34 provided on the inner surface of the bush 28.

Accordingly, the dials 21, 22 can rotate under a normal condition, and when positions of the concave grooves 30, 31 agree with the longitudinal projections 32, 33 respectively, those bushes can be shifted in the axial direction by the push button being depressed, which makes it possible to operate the stopper 5 via the slide plate 18.

Furthermore, the retainers 23, 24 are designed to be allowed to slide in the axial direction, but are prevented from rotating. One of the retainers 23 is provided with projecting pieces on both sides opposing each dial 21 and 22 and those dials 21, 22 have concavities corresponding to the codes for engaging with longitudinal projections provided on both sides of the retainer 23. This arrangement makes codes on the dials 21, 22 stop at the predetermined points of the window opening 27.

The code lock 6 is composed of the bushes 28, 29 having longitudinal projections 35, 35 on their outer peripheral surface and dials 21, 22 having concave grooves 36, 36 on their inner surfaces for engaging with and disengaging from said longitudinal projections 35, 35 correspondingly. Furthermore, a spring 37 is arranged between the bush 28 and the push board 13 and pressing number 38 is arranged between the push button and another bush 29, while a through hole is provided in the push button to allow a push rod to push through the hole.

Now the operation of said embodiment will be described hereinafter.

For locking the code lock by engaging the rotary hook 3 with the stationary hook 2, the lock-releasing codes of the two dials 21, 22 are in alignment in the window opening 27 of the cylindrical case 12 when the longitudinal projection 15 is depressed on the back surface of the rotary hook 3.

Then, when the rotary hook 3 is rotated manually by the handle 9 to engage the stationary hook 2, the rotary hook 3 is removed from the position of the projection piece 15 of the stopper 5 and the projection piece 15 pushes to stop reverse rotation of the rotary hook 3 by the force of compression spring 19. Under this condition, when the arrangement of codes of the dials 21, 22 are changed randomly by rotation, the concave grooves 30 and 31 of the dial 21, 22 are separated from the corresponding longitudinal projections 32 and 33 and both dials 21, 22 are blocked from their sliding on the supporting shaft 20. Thus, the stopper 5 keeps the rotary hook 3 in the lock-hold mode.

In order to unlock the lock device, the dials 21, 22 are rotated separately to arrange the lock-releasing code in the window opening 27. By depressing the push button 25 of the operation unit 7 with a finger, the dials 21, 22 shift along the supporting shaft 20, and this causes the spring 19 to compress and shift the stopper 5. The projection 15 of the stopper 5 retreats from the surface of the rotation of the rotary hook 3 and the handle 9 is allowed to turn the rotary hook 3 to the unlocking side.

For changing the lock-releasing code, the previously set lock-releasing codes is placed in alignment under the window opening 27 first, and after making concave grooves 30 and 31 agree with the longitudinal projections 32 and 33 respectively, pressing member 38 with a push rod through the hole 39. Then the bushes 28, 29 in engagement with the internal holes of the dials 21, 22 are released from those dials and the longitudinal projection 35 is disengaged from the concave groove 36. In this state, new lock release codes may be arranged using dials 21 and 22. By removing the pressing force from the pressing number 38, the bushes 28, 29 are put into engagement with the internal holes of dials 21, 22 respectively, engaging the longitudinal projection 35 in the concave groove 36. In this state, the new lock-releasing codes are arranged using dials 21, 22. Then, by removing the pressing force from the pressing member 38, the bushes 28, 29 are put into engagement with the internal holes of the dials 21, 22 respectively by the pressing force of the spring 37, and setting of the new lock-releasing code is finished.

FIGS. 5 through 9 show a second embodiment of this invention.

In the case of this embodiment, the operation unit 7 is attached to the longitudinal projection 15 of the stopper 5 and the lock-hold mode is designed to be released automatically when the rotary hook 3 is simply rotated, as against the case of the first embodiment, in which the longitudinal projection 15 of the stopper 5 retreats from the rotation path of the rotary hook 3 when the operation unit 7 of the code lock 6 pressed and as a result the lock-hold mode is released.

The following is a detailed description of the second embodiment of the present invention. As regards the double sliding doors **1*a* and 1*b*, the stationary hook 2, the rotary hook 3, and the restriction piece 14** in the second embodiment are all the same in configuration as in the first embodiment. Descriptions are omitted, therefore, with the same parts being given the same numerals and codes as in the first embodiment.

In the same figure, a setting base 40 of the rotary hook 3 is equipped with a stopper 5 which rises and retracts from the rotational path of the rotary hook 3, and a code lock 6 which sets the rotary hook 3 either at a lock-hold mode or lock-release mode.

The stopper 5 is installed in a through hole 41 of the setting base 40 and the upper end of the stopper 5 is in the shape of a tapered surface 42 to form the operation unit 7. The operation unit 7 makes the tapered surface 42 through the hole 41 rise above the surface of the setting base 40 to block rotation of the rotary hook 3 or to retreat from the surface to allow rotation of the hook. The bottom end of the stopper 5 is connected to the code lock 6 via a swing lever 43.

The code lock 6, being screw-fixed on the setting base 40, is composed of a case 47 having a plurality of opening windows 45, 46, a working shaft 48 being arranged freely-slidably in the case 47, and a plurality of dials 49 and 50 engaging the opening windows 45, 46 respectively and being freely-rotatably supported by the working shaft 48. The working shaft 48 has a plurality of projections 51, 52 on its outer surface and the end of the shaft contacts the swing lever 43 and the shaft is pushed by a spring 53. Both dials 49, 50 have codes on their outer surfaces respectively. Bushes 54, 55 are fit to engage the internal holes of the dials 49, 50 respectively, and have concave grooves 56, 57 at their specified angle positions of the inner surfaces respectively. Furthermore, the grooves 56, 57 are arranged to engage the longitudinal projections 51, 52.

On each outer surface of the dial 49, 50, there are concavities between neighboring codes and on the other hand a spring ball 59 is provided in the case 47 to fix the position of a code when the spring ball 59 is pressed into a concavity of the outer surface of each dial 49 or 50.

The code lock 6 having the construction as described above has a built-in code setting mechanism which can set the lock-releasing code at will.

In the code setting mechanism, the bushes 54, 55 have projections 60 respectively on their outer surfaces and the dials 49, 50 have concave grooves 61 respectively so that the grooves 61 can engage the longitudinal projection 60 and the number of grooves or projections corresponds to the number of codes. Furthermore, a spring 62 is placed between one of the bushes 54 and the push plate 44 and between the other bush 55 and the top of the case a pressing member 63 is arranged and a hole 64 is provided for inserting a push rod at the top of the case.

Now, the operation of the second embodiment will be described hereinafter.

When the rotary hook 3 is not engaged with the stationary hook 2, the stopper 5 is depressed by the rotary hook 3. At this time, the working shaft 48 is slid upward by the stopper 5 via the swing lever 43 and the longitudinal projections pieces 51, 52 stay in the concave groove 56 on the bush 54 and the groove 57 on the bush 55 respectively. Thus, the dials 49 and 50 can not rotate.

When the rotary hook 3 is engaged with the stationary hook 2, the stopper 5 is released from depression by the rotary hook 3 and the working shaft 48 is kept depressed by the spring 53, protruding the stopper 5 onto the setting base 40 to engage the back side of the rotary hook 3. At this time, the longitudinal projection pieces 51, 52 of the working shaft 48 are disengaged from the concave grooves 56, 57 of the bush 54, 55.

For keeping the lock device at the lock-hold mode, blocking the operation of the stopper 5, sliding of the working shaft is obstructed by rotating each dial at random to place the alignment of codes irregularly which disengages the longitudinal projection pieces 51, 52 of the working shaft 48 from the concave grooves 56, 57 of the bushes 54, 55 respectively, causing to block the slide of the working shaft 48. Consequently, the stopper 5 is kept protruding onto the setting base 40 and the rotary hook 3 is blocked to turn to the lock-release mode, setting the lock-hold mode.

Meanwhile, for unlocking the lock device, turning the dials 49, 50 align the lock-releasing codes, and will bring the concave grooves 56, 57 of the bush 54, 55 to the corresponding positions respectively of the longitudinal projection pieces 51, 52 of the working shaft. If the rotary hook 3 is turned toward the unlocking direction at this time, the rotary hook 3 depresses the tapered surface 42. By this, the working shaft 48 is slid via the swing lever 43, pressing the stopper 5 into the setting base 40 to allow the rotary hook 3 to the lock-release mode.

In order to change the lock-releasing code, after aligning the previously set lock-releasing code at first, bringing each concave grooves 56, 57 to the corresponding positions of the projection pieces respectively, the push rod is inserted through the insertion hole of the case 47 to press the pressing member 63. This action compresses the spring 62 leading the bushes 54, 55 released from dials 49, 50 respectively, disengaging the longitudinal projection 60 from the concave groove 61. After that, a new releasing code is set up by using the dials 49, 50 and then, if pressure on the pressing member 63 is released, the bushes 54, 55 come to be engaged with the internal holes of the dials 49, 50 respectively by the compression force of the spring 62, completing the establishment of a new lock-releasing code.

Figure 9:
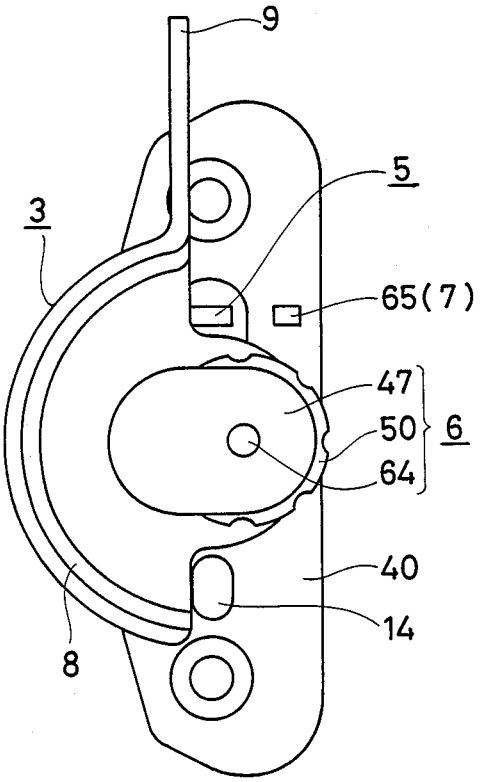
FIG. 9 is a front view of the lock device according to a third embodiment of this invention.
Figure 10:
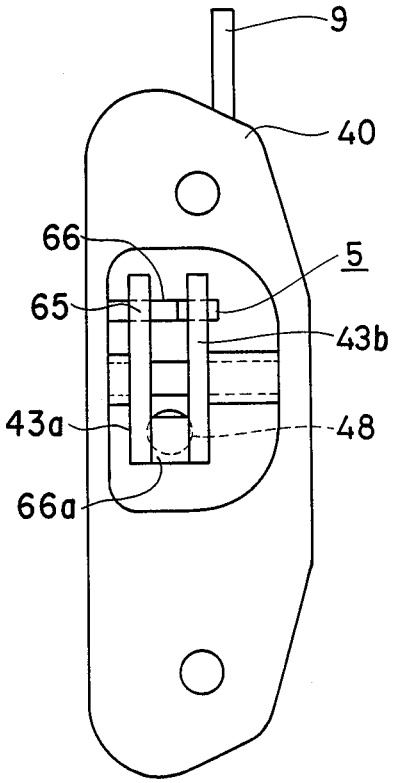
FIG. 10 is a rear view of the third embodiment of the lock device invention.

FIGS. 9 and 10 show a third embodiment of the present invention.

While the operation unit 7 is arranged with a code lock 6 as in the first embodiment, and the same operation unit 7 is arranged with the stopper 5 as in the second embodiment, in the third embodiment, the operation unit 7 is constructed by arranging a push button 65 for applying pressure which is connected with the swing lever at an appropriate place on the setting base 40. Furthermore, the configuration of this third embodiment is the same as the second embodiment except the part of the operation unit 7. Their description are, therefore, omitted herein except that only the corresponding numerals are given to the corresponding components.

In the case of the third embodiment, after aligning the lock-releasing codes for unlocking the lock device, depressing the push button 65, which is connected to the stopper 5 by the cross bar 66, with a finger will result in the working shaft 48 sliding upwardly in the case 47 via the swing lever 43, and the stopper 5 will be pushed into the setting base 40, which allows the rotary hook 3 to turn to the lock-releasing side. The swing lever 43 has two sections **43*a* and 43*b* joined at one end by the cross bar 66 and at the other end by the cross bar 66*a***.

As mentioned in the above, this is an invention of a lock device composing of a stationary hook to be fixed on one of the double sliding doors and a rotary hook to be engaged with and released from it, wherein a stopper arranged to rise above or retreat from the path of rotation of the rotary hook, a code lock to keep the lock-hold and release modes of the lock device by controlling said rising and retreating actions of the stopper, and an operation unit for forcing the stopper to retreat out of the rotation path of the rotary hook when said code lock is in the lock-hold mode are provided. By controlling the action of the stopper by the code lock while the lock is in lock-hold mode, therefore, the rotary hook is blocked from turning. Even in case when a part of glass of the double sliding doors is broken and a hand may be inserted to reach the lock device, it is impossible to release the lock-hold mode easily to unlock it, meaning that it assures a very high degree of safety.

In such a case when this lock is equipped to all windows of a building, it is possible to establish a different lock-releasing code to all windows, improving locking performance and advantage of locking a great deal, attain the object of the invention conspicuously.

Descriptions were made in the above on the preferred embodiments of the invention. For the interested parties, however, it is quite possible to resort to various amendments without departure from the basic concept of this invention. Consequently, the scope of the invention can be limited only by the appended claims.

What is claimed is:

1. In a lock device for double sliding doors comprising a base means adapted to be mounted on one of said double sliding doors, a stationary hook means adapted to be mounted on the other of said double sliding doors, said base means comprising a base portion and a cylindrical portion extending from said base portion, a rotary hook means rotatably mounted on said base means between a locked position in which said rotary hook means engages said stationary hook means and an unlocked position in which said rotary hook means is disengaged from said stationary hook means, said rotary hook means being rotatable about an axis which is coincident with the longitudinal axis of said cylindrical portion, movable stopper means mounted on said base means and movable between a locked position in which a part of the stopper means is disposed within the rotational path of movement of said rotary hook means and an unlocked position in which said part of said stopper means is disposed outside the rotational path of movement of said rotary hook means, said movable stopper means having a second part disposed in said cylindrical portion, said second part being movable longitudinally in said cylindrical portion as said stopper means moves between its locked and unlocked positions, said stopper means further comprising biasing means in said cylindrical portion and engaging said second part to bias said stopper means in its locked position, combination lock means mounted on said base means, said combination lock means having a plurality of rotary wheels which are manually rotatable to a preset combination code-open position, said combination lock means also having a code-lock position when said rotary wheels are in a position other than said preset combination code-open position, said combination lock means when in said code-lock position retaining said stopper means in said locked position and when in said preset combination code-open position releasing said stopper means to an unlocked position, whereby said combination lock means controls the locking and unlocking of the lock device, and manually engageable push button means on said cylindrical portion, said push button means engaging at least a section of said combination lock means when the combination lock means is in said code-open position to move said section longitudinally to engage and overcome the bias of said biasing means and thereby move said movable stopper means from its locked to its unlocked position.

2. In a lock device according to claim 1 wherein said rotary wheels are rotatably mounted in said cylindrical portion for rotation about said longitudinal axis of said cylindrical portion.

3. In a lock device according to claim 1 wherein said combination lock means comprises operable means for changing the preset combination code-open position of said rotary wheels.

4. In a lock device according to claim 1 wherein said base means has an opening, said one part of said stopper means being movable in said opening between said locked and unlocked position, said opening being disposed radially outwardly of said cylindrical portion.

5. In a lock device according to claim 1 wherein said one part of said stopper means has a tapered portion engageable by said rotary hook means to move said one part from its position within the rotational path of movement of said rotary hook means to its position disposed outside the rotational path of movement of said rotary hook means.

6. In a lock device according to claim 1 wherein said base means has a generally planar upper side which is generally parallel to said one sliding door on which said base means is mounted, said cylindrical portion extending from said planar upper side with the longitudinal axis of said cylindrical portion being perpendicular to said planar upper side.

7. In a lock device according to claim 6 wherein said rotary hook means has an opening, said cylindrical portion extending through said opening.

8. In a lock device according to claim 7 wherein the center of said opening in said rotary hook means defines the axis of rotation of said rotary hook means, the axis of rotation of said rotary hook means being coincident with the longitudinal axis of said cylindrical portion.

* * * * *